US007249680B2

(12) United States Patent
Wang

(10) Patent No.: US 7,249,680 B2
(45) Date of Patent: Jul. 31, 2007

(54) SHOE RACK

(75) Inventor: Chi-Chung Wang, Kaohsiung Hsien (TW)

(73) Assignee: Chi Yu Steel Co., Ltd., Kaohsiung Hsien (TW)

( * ) Notice: Subject to any disclaimer, the term of this patent is extended or adjusted under 35 U.S.C. 154(b) by 439 days.

(21) Appl. No.: 11/025,926

(22) Filed: Jan. 3, 2005

(65) Prior Publication Data

US 2006/0144805 A1 Jul. 6, 2006

(51) Int. Cl.
*A47F 7/08* (2006.01)
*A47F 5/08* (2006.01)

(52) U.S. Cl. ..... 211/37; 211/36; 211/150; 211/169; 211/206

(58) Field of Classification Search ..... 211/34, 211/37, 38, 36, 47, 96, 81, 106, 110, 188, 211/133.5, 126.6, 169, 126.9, 149, 132.1, 211/150, 133.2, 168, 182, 204, 206, 90.03, 211/90.02; 248/241, 249, 242, 250; D6/566; 403/83, 84, 103; 108/181, 158.11, 147.17–42
See application file for complete search history.

(56) References Cited

U.S. PATENT DOCUMENTS 2,379,975 A * 7/1945 Luger ..... 211/99
3,665,377 A * 5/1972 MacKenzie, Jr. ..... 439/713
4,316,593 A * 2/1982 Miner et al. ..... 248/250
5,351,842 A * 10/1994 Remmers ..... 211/90.03
5,749,480 A * 5/1998 Wood ..... 211/169.1
5,816,419 A * 10/1998 Lamson ..... 211/150
6,158,600 A * 12/2000 Ferrucci et al. ..... 211/90.02
6,234,328 B1 * 5/2001 Mason ..... 211/90.02
6,290,075 B1 * 9/2001 Cheimets et al. ..... 211/90.03
2007/0012637 A1 * 1/2007 Yu et al. ..... 211/96

* cited by examiner

*Primary Examiner*—Jennifer E. Novosad
(74) *Attorney, Agent, or Firm*—Bacon & Thomas, PLLC

(57) ABSTRACT

A shoe rack has two supports respectively and detachably mounted on top of the two elongated bases, a top tube detachably connected to free ends of the two supports via connectors and multiple shoe resting brackets sandwiched between the two supports. Each shoe resting bracket is adjustably connected to the two supports via a fixture which a first cutout, a second cutout, a first indentation defined in a side face defining the first cutout and a second indentation defined in a side face defining the second cutout. When the rods are received in the first cutout and the second cutout, the shoe resting bracket is tilted relative to a horizontal surface and when the two rods are received in the first indentation and the second indentation, the shoe resting bracket is parallel to the horizontal surface.

13 Claims, 7 Drawing Sheets

SHOE RACK

BACKGROUND OF THE INVENTION

1. Field of the Invention

The present invention relates to a shoe rack, and more particularly to shoe rack having shoe resting brackets stacked on top of each other and being adjustable to allow shoes to be displaced in different angles.

2. Description of Related Art

A shoe rack is provided for the users to place their shoes when not in use. Normally, a shoe rack has multiple shoe resting brackets stacked on top of each other so that the user is able to insert the shoes into the gaps between the shoe resting brackets and places the shoes on top of the shoe resting brackets. Because the conventional shoe resting brackets are fixed on the shoe rack it is sometimes difficult for the user to have access to the shoes especially when the shoe resting brackets are not orthogonal to the supports of the shoe rack. Furthermore, the quantity of pairs of shoes placed on top of the shoe resting brackets is fixed such that there is no way to place additional pairs of shoes on the shoe rack. Each shortcoming bothers the shoe rack user for there is no solution to the problem except buying another shoe rack of a different structure, which is impractical and a waste of money.

To overcome the shortcomings, the present invention tends to provide an improved shoe rack to mitigate the aforementioned problems.

SUMMARY OF THE INVENTION

The primary objective of the present invention is to provide a shoe rack having adjustable shoe resting brackets to allow the shoes to be displaced in different angles.

Another objective of the present invention is that the support of the shoe rack is extendable so that whenever there is a demand exceeding supply of space, the user is able to extend the support so as to accommodate additional shoes.

Still another objective of the present invention is to provide an errorproof device on the shoe rack to ensure the assembly of the shoe rack is correct.

In order to accomplish the foregoing objective, the shoe rack of the present invention has two opposite supports and shoe resting brackets adjustably sandwiched between the two supports via fixtures.

Each fixture has a first cutout and a second cutout defined in a side face of the fixture. The first cutout has a first indentation defined in a side face forming the first cutout. The second cutout has a second indentation defined in a side face forming the second cutout. The first cutout has a depth greater than that of the second cutout and the first indentation has a depth greater than that of the second indentation. Both the first indentation and the second indentation are tilted relative to the first cutout and the second cutout so that in a situation where two rods extending from a side of the shoe resting bracket are simultaneously received in the first cutout and the second cutout, the shoe resting bracket is displaced at an angle relative to a horizontal surface and where the two rods are simultaneously received in the first indentation and the second indentation, the shoe resting bracket is parallel to the horizontal surface.

The errorproof device includes a hole defined in a side face of the support, a slit defined in the side face of the support to communicate with the hole, an insert having two clamps extending from an outer periphery of the insert to correspond to and extend into the hole and a rib formed with the insert to be sandwiched by and extending out of the two clamps to correspond to the slit and a passage defined in a rear face of the fixture so that orientation of the fixture in relation to the insert is fixed.

Other objects, advantages and novel features of the invention will become more apparent from the following detailed description when taken in conjunction with the accompanying drawings.

DETAILED DESCRIPTION OF THE PREFERRED EMBODIMENT

Figure 1:
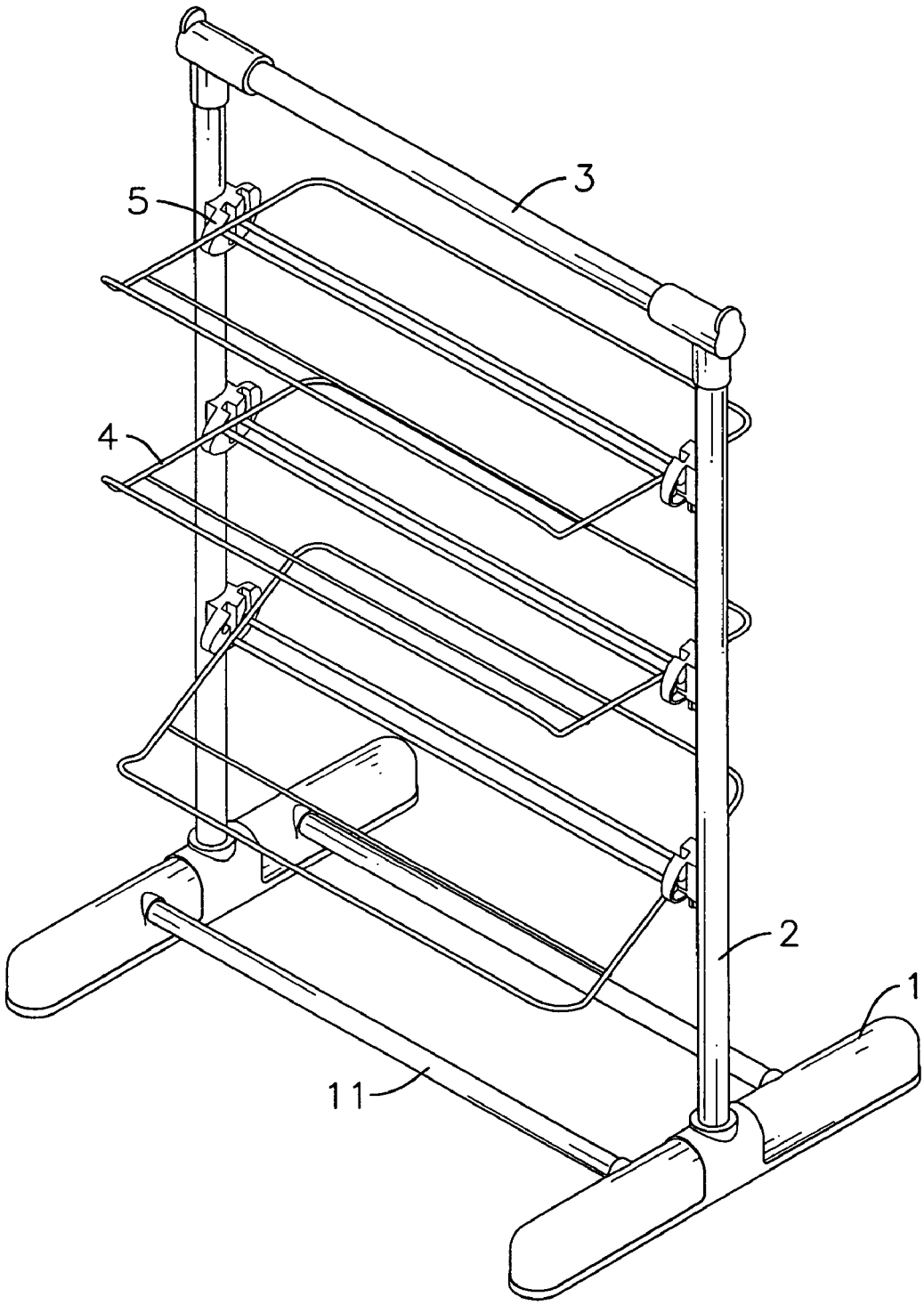
FIG. 1 is a perspective view showing the shoe rack of the present invention.

With reference to FIG. 1, the shoe rack in accordance with the present invention includes two elongated bases (1) interconnecting with each other via two connecting tubes (11), two supports (2) respectively and detachably mounted on top of the two elongated bases (1), a top tube (3) having a first end detachably connected to a free end of one of the supports (2) and a second end detachably connected to a free end of the other one of the supports (2) and multiple shoe resting brackets (4) detachably and adjustably mounted between the two supports (2) via fixtures (5).

Figure 2:
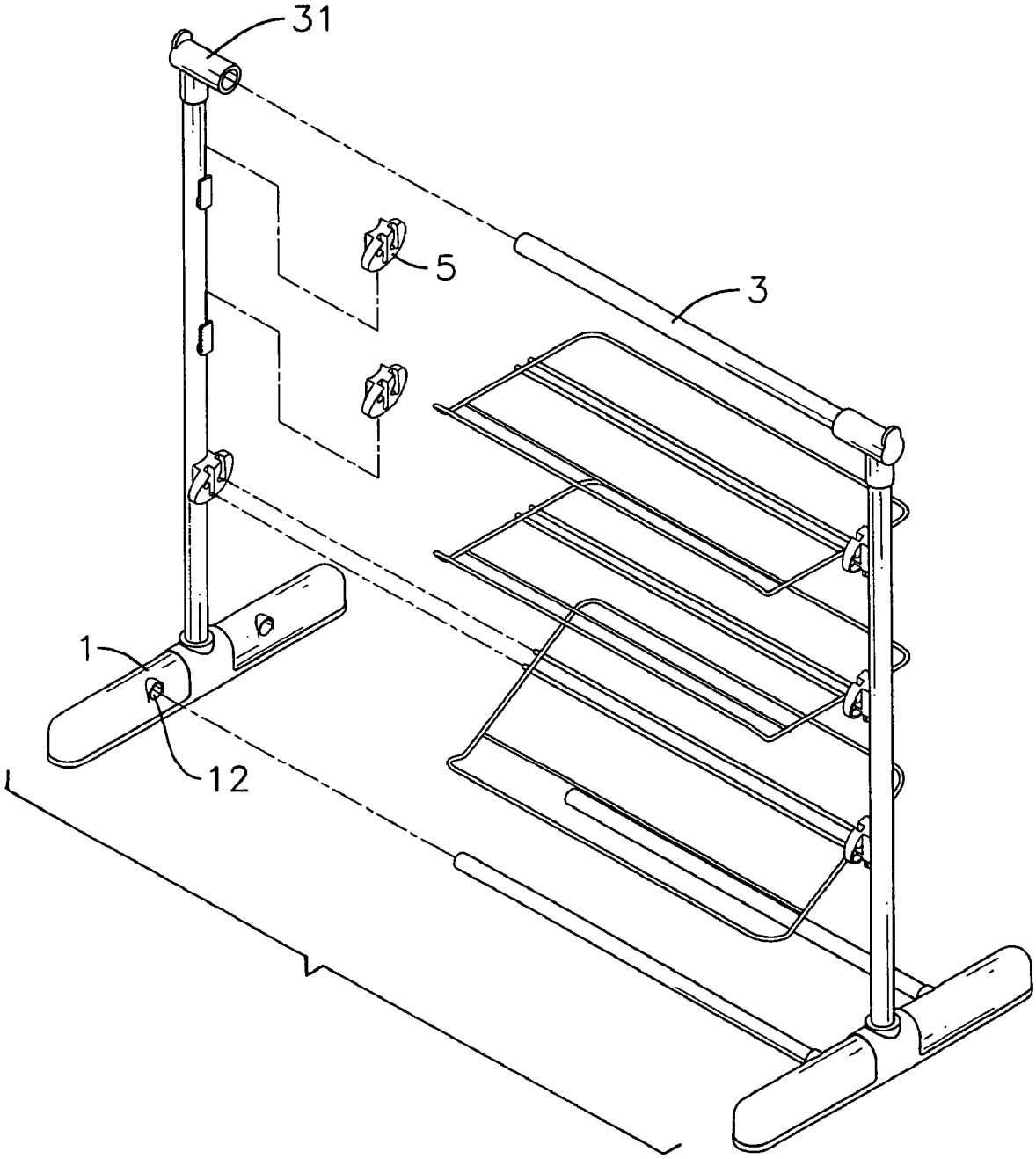
FIG. 2 is an exploded perspective view of the shoe rack in FIG. 1.
Figure 3:
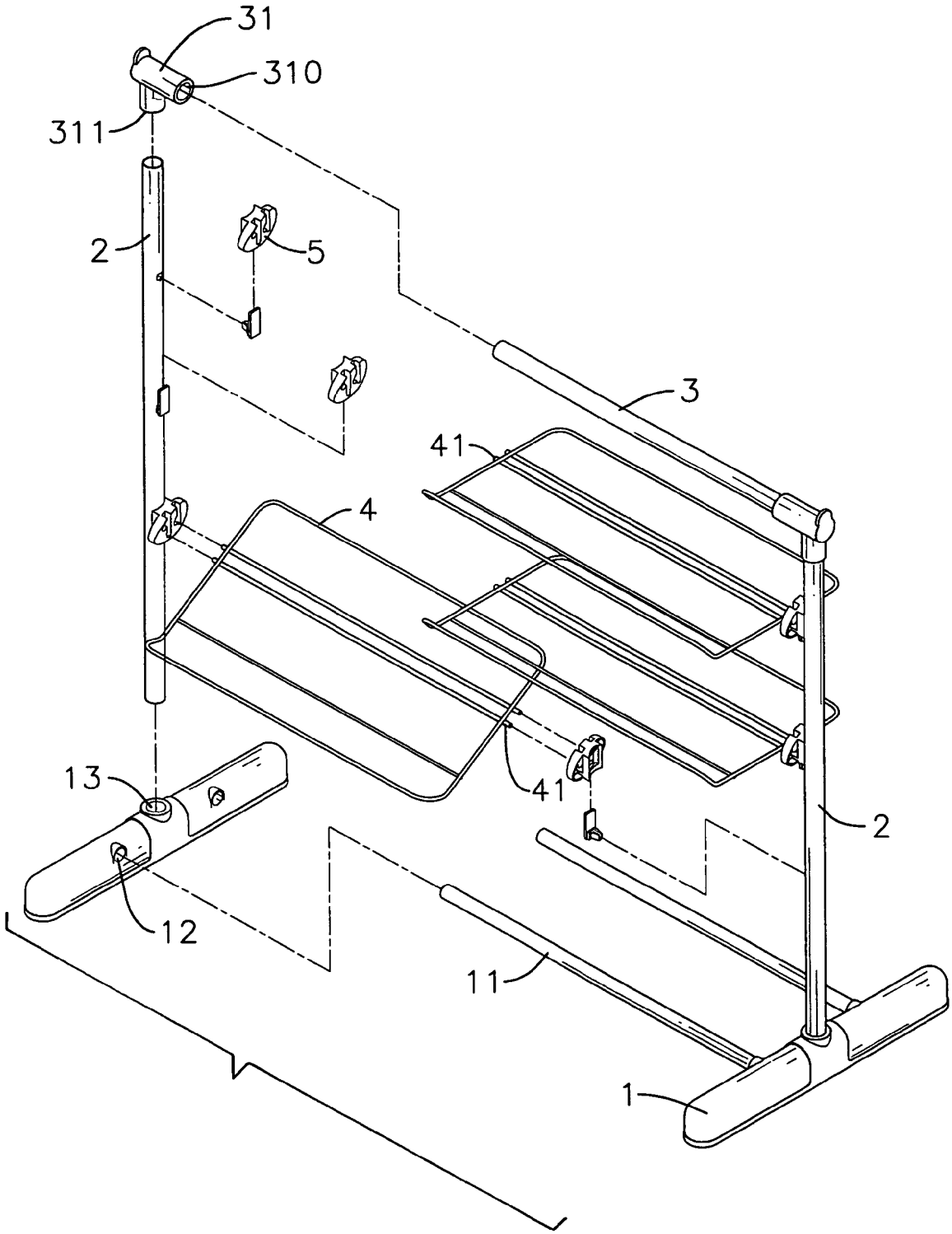
FIG. 3 is still another exploded perspective view of the shoe rack in FIG. 1, wherein the fixture and the insert are shown.

With reference to FIGS. 2 and 3, it is noted that each elongated base (1) has two first connecting holes (12) defined in an inner side face of the elongated base (1) to correspond to the two connecting tubes (11) such that the two connecting tubes (11) are able to extend into the corresponding first connecting holes (12) to combine the two elongated bases (1), and a second connecting hole (13) respectively defined in a top face of each elongated base (1) to correspond to bottom ends of the two supports (2) such that the two supports (2) are able to be detachably mounted on the two elongated bases (1) via the two second connecting holes (13). The top tube (3) is connected to the two free ends (top ends) of the two supports (2) via two connectors (31) respectively having a first extension hole (310) to correspond to and receive therein an end of the top tube (3) and a second extension hole (311) to correspond to and receive therein the free end of one of the two supports (2). Each of the shoe resting brackets (4) is substantially rectangular and has four sides. Two rods (41) are extending from a respective one of two opposite sides of the shoe resting bracket (4) sandwiched between the two supports (2).

Figure 4:
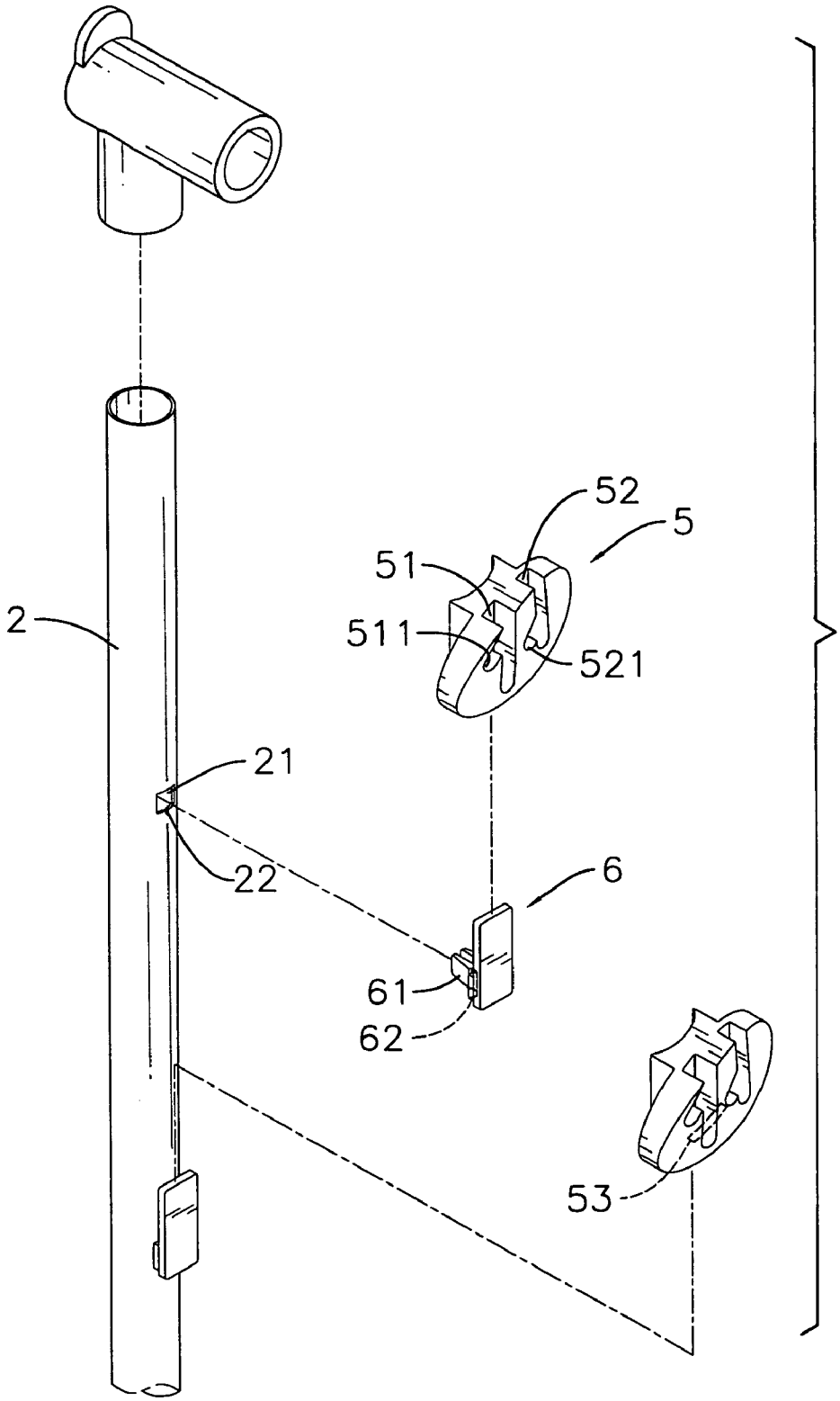
FIG. 4 is an enlarged exploded perspective view showing the fixture and the insert.

With reference to FIG. 4, it is noted that the fixture (5) has a first cutout (51) and a second cutout (52) defined in a side face of the fixture (5). The first cutout (51) has a first indentation (511) defined in a side face forming the first cutout (51). The second cutout (52) has a second indentation (521) defined in a side face forming the second cutout (52). The first cutout (51) has a depth greater than that of the second cutout (52) and the first indentation (511) has a depth greater than that of the second indentation (521). Both the first indentation (511) and the second indentation (521) are tilted relative to the first cutout (51) and the second cutout (52) so that in a situation where two rods (41) extending from a side of the shoe resting bracket (4) are simultaneously received in the first cutout (51) and the second cutout (52), the shoe resting bracket (4) is displaced at an angle relative to a horizontal surface and where the two rods (41) are simultaneously received in the first indentation (511) and the second indentation (521), the shoe resting bracket (4) is parallel to the horizontal surface. Therefore, it is noted that the shoe resting brackets (4) are adjustably sandwiched between the two supports (2).

Still referring to FIG. 4, the errorproof device includes a hole (21) defined in a side face of the support (2), a slit (22) defined in the side face of the support (2) to communicate with the hole (21), an insert (6) having two clamps (61) extending from an outer periphery of the insert (6) to correspond to and extend into the hole (21) and a rib (62) formed with the insert (6) to be sandwiched by and extending out of the two clamps (61) to correspond to the slit (22) and a passage (53) defined in a rear face of the fixture (5) so that orientation of the fixture (5) in relation to the insert (6) is fixed. That is, because of the mutual corresponding of the combination of the hole (21) and the slit (22) to the combination of the two clamps (61) and the rib (62), orientation of the insert (6) to the support (2) is fixed. Further, due to the passage (53) defined in the rear side face of the fixture (5) to correspond to the insert (6), the combination of the insert (6) and the fixture (5) is fixed.

Figure 5:
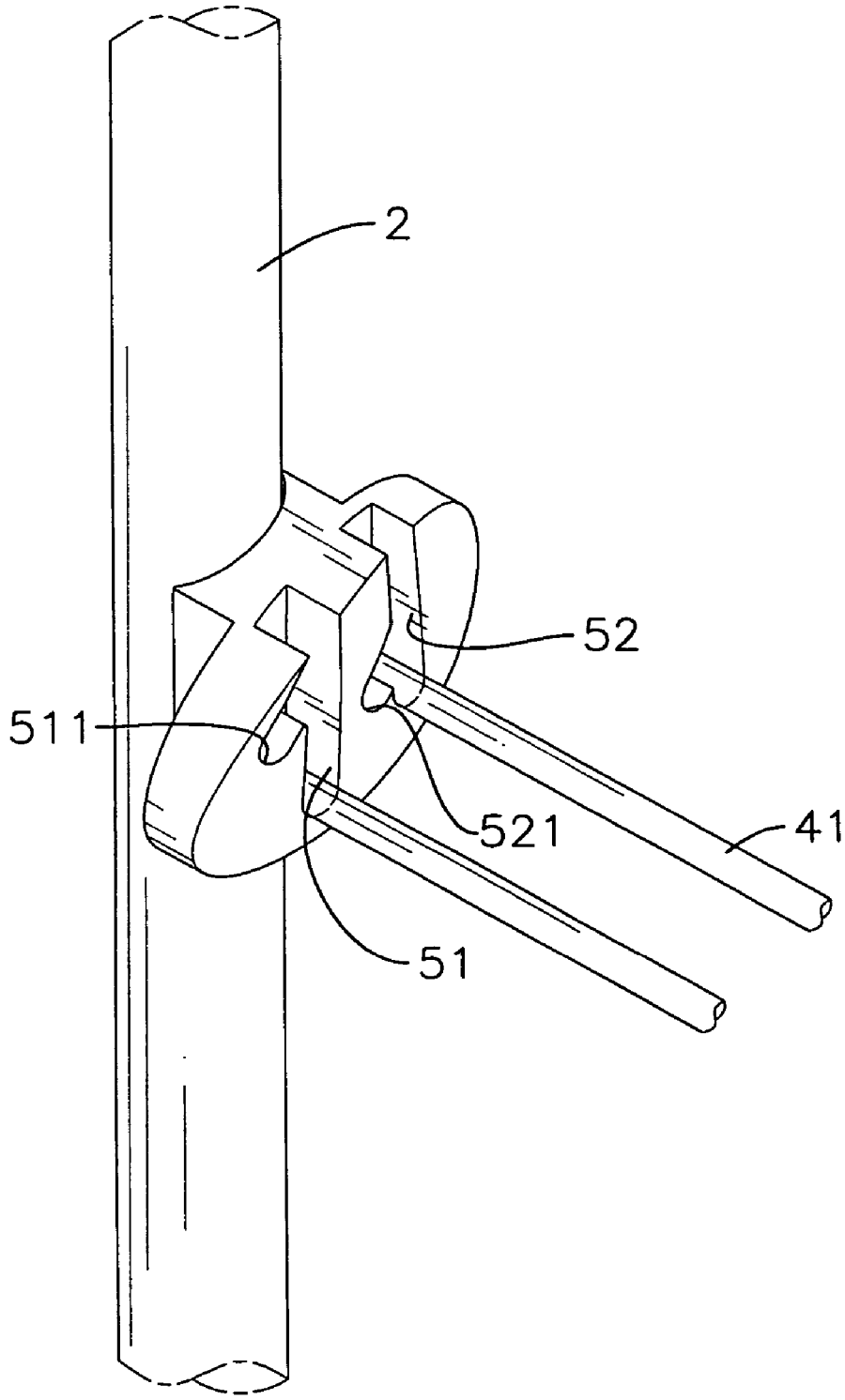
FIG. 5 is a schematic perspective view showing that the two rods are respectively received in the first cutout and the second cutout to displace the shoe resting bracket at an angle relative to a horizontal surface.
Figure 6:
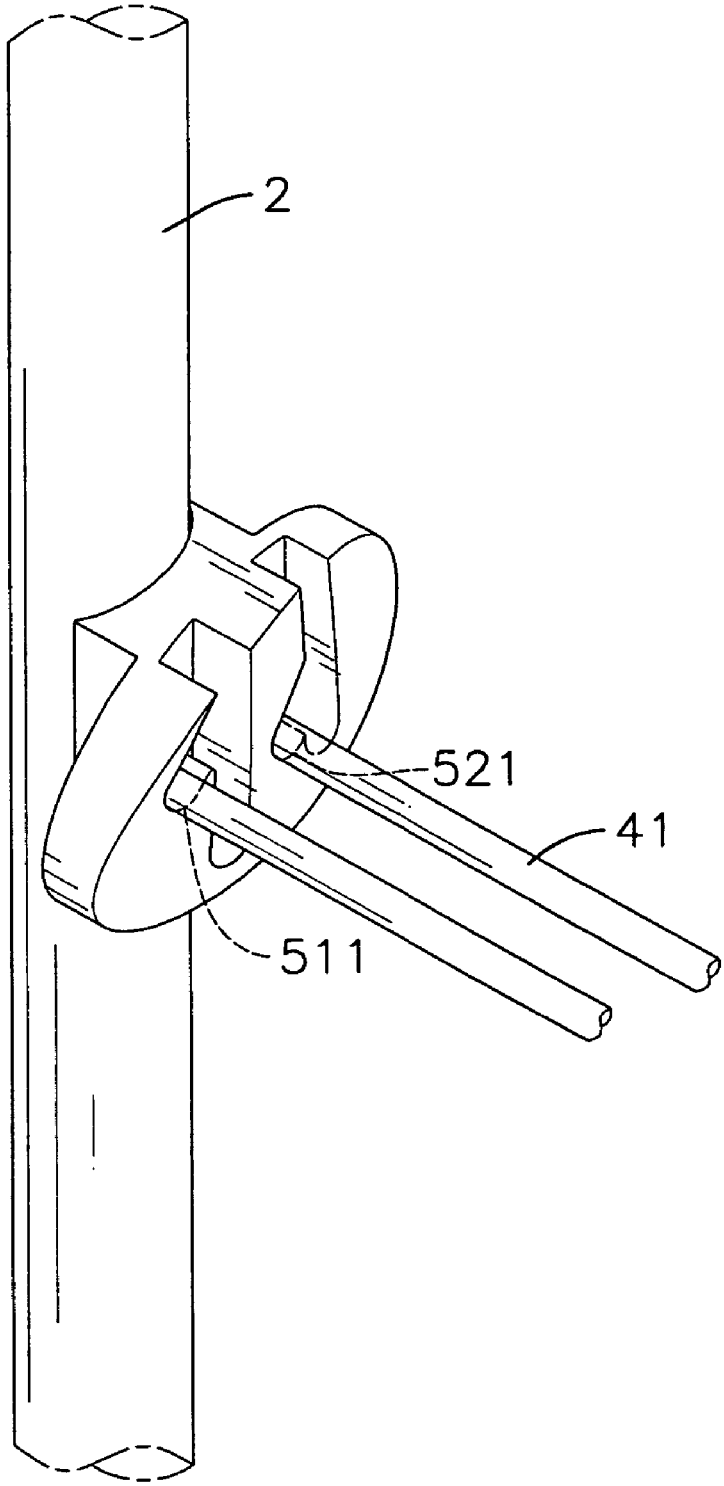
FIG. 6 is a schematic perspective view showing that the two rods are respectively received in the first indentation and the second indentation to displace the shoe resting bracket parallel to the horizontal surface.

In order to have a better understanding of the operation of the shoe resting brackets (4) relative to the supports (2), FIGS. 5 and 6 are presented to show that when the two rods (41) are respectively received in the first cutout (511) and the second cutout (52), the shoe resting bracket (4) is tilted relative to a horizontal surface, e.g. ground, and when the two rods (41) are respectively received in the first indentation (511) and the second indentation (521), the shoe resting bracket (4) is parallel to the horizontal surface.

Figure 7:
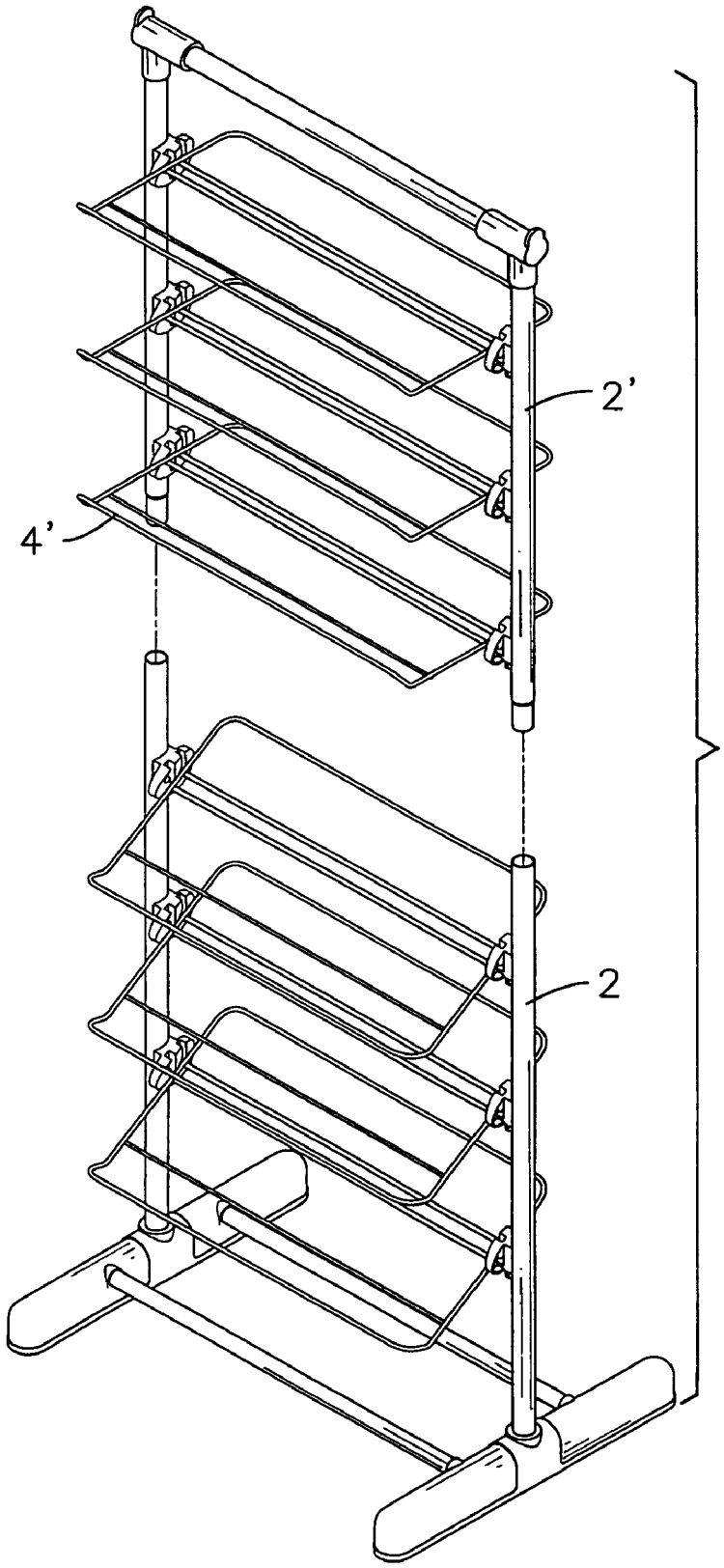
FIG. 7 is an exploded perspective view showing that the height of the shoe rack of the present invention is increased.

With reference to FIG. 7, it is noted that when the shoe receiving volume of shoe rack of the present invention is not enough, the user is able to remove the two connectors (31) as well as the top tube (3) to add a further two supports (2') with additional shoe resting brackets (4') sandwiched between the two further supports (2') to be on top of the two supports (2). Then the connectors (31) as well as the top tube (3) are mounted on top of the two additional supports (2'). Therefore, the shoe receiving volume as well as the height of the present invention is increased.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a shoe rack having two elongated bases, two supports respectively and detachably mounted on top of the two elongated bases, a top tube detachably connected to free ends of the two supports via connectors and multiple shoe resting brackets sandwiched between the two supports, wherein the improvement comprises:

each shoe resting bracket having two opposite sides respectively provided with two rods extending out therefrom for connection with one of the two supports via a fixture which is detachably mounted on a corresponding one of the supports and has a first cutout, a second cutout, a first indentation defined in a side face defining the first cutout and a second indentation defined in a side face defining the second cutout, wherein in a situation where the rods from opposite sides of the shoe resting bracket are respectively received in the first cutout and the second cutout of the fixtures on the two supports, the shoe resting bracket is tilted relative to a horizontal surface and in a situation where the two rods from opposite sides of the shoe resting bracket are respectively received in the first indentation and the second indentation of the fixtures on the two supports, the shoe resting bracket is parallel to the horizontal surface, whereby the shoe resting bracket is adjustably arranged between the two supports to allow shoes to be arranged on top of the shoe resting brackets in different angles.

2. The shoe rack as claimed in claim 1, wherein the first cutout has a depth greater than the depth of the second cutout, the first indentation has a depth greater than that the depth of the second indentation.

3. The shoe rack as claimed in claimed in claim 2, wherein the first indentation is tilted relative to the first cutout and the second indentation is tilted relative to the second cutout.

4. The shoe rack as claimed in claim 3 further comprising an errorproof device which is provided between the fixture and the corresponding support to ensure assembly of the fixture to the corresponding support is correct.

5. The shoe rack as claimed in claim 4, wherein the errorproof device includes:

a hole defined in a side face of the support;

a slit defined in the side face of the support to communicate with the hole;

an insert having two clamps extending from an outer periphery of the insert to correspond to and extend into the hole and a rib formed with the insert to be sandwiched by and extending out of the two clamps to correspond to the slit; and a passage defined in a rear face of the fixture so that orientation of the fixture in relation to the insert is fixed.

6. The shoe rack as claimed in claim 2 further comprising an errorproof device which is provided between the fixture and the corresponding support to ensure assembly of the fixture to the corresponding support is correct.

7. The shoe rack as claimed in claim 6, wherein the errorproof device includes:

a hole defined in a side face of the support;

a slit defined in the side face of the support to communicate with the hole;

an insert having two clamps extending from an outer periphery of the insert to correspond to and extend into the hole and a rib formed with the insert to be sandwiched by and extending out of the two clamps to correspond to the slit; and a passage defined in a rear face of the fixture so that orientation of the fixture in relation to the insert is fixed.

8. The shoe rack as claimed in claim 1 further comprising an errorproof device which is provided between the fixture and the corresponding support to ensure assembly of the fixture to the corresponding support is correct.

9. The shoe rack as claimed in claim 8, wherein the errorproof device includes:

a hole defined in a side face of the support;

a slit defined in the side face of the support to communicate with the hole;

an insert having two clamps extending from an outer periphery of the insert to correspond to and extend into the hole and a rib formed with the insert to be sandwiched by and extending out of the two clamps to correspond to the slit; and a passage defined in a rear face of the fixture so that orientation of the fixture in relation to the insert is fixed.

10. In a shoe rack having two elongated bases, two supports respectively and detachably mounted on top of the two elongated bases, a top tube detachably connected to free ends of the two supports via connectors and multiple shoe resting brackets sandwiched between the two supports, wherein the improvement comprises:

each shoe resting bracket having two opposite sides respectively provided with two rods extending out therefrom for connection with one of the two supports via a fixture which is detachably mounted on a corresponding one of the supports and has a first cutout, a second cutout, a first indentation defined in a side face defining the first cutout and a second indentation defined in a side face defining the second cutout, wherein in a situation where the rods from opposite sides of the shoe resting bracket are received in the first cutout and the second cutout of the fixtures on the two supports, the shoe resting bracket is tilted relative to a horizontal surface and in a situation where the two rods from opposite sides of the shoe resting bracket are received in the first indentation and the second indentation of the fixtures on the two supports, the shoe resting bracket is parallel to the horizontal surface, wherein an errorproof device is provided between the fixture and the corresponding support to ensure assembly of the fixture to the corresponding support is correct, whereby the shoe resting bracket is adjustably arranged between the two supports to allow shoes to be arranged on top of the shoe resting brackets in different angles.

11. The shoe rack as claimed in claim 10, wherein the first cutout has a depth greater than a depth of the second cutout, the first indentation has a depth greater than a depth of the second indentation, wherein the first indentation is tilted relative to the first cutout and the second indentation is tilted relative to the second cutout.

12. The shoe rack as claimed in claim 11, wherein the supports are extendable so that additional shoe resting brackets are able to be sandwiched between the extended supports to increase shoe receiving volume.

13. The shoe rack as claimed in claim 12, wherein the errorproof device includes:

a hole defined in a side face of the support;

a slit defined in the side face of the support to communicate with the hole;

an insert having two clamps extending from an outer periphery of the insert to correspond to and extend into the hole and a rib formed with the insert to be sandwiched by and extending out of the two clamps to correspond to the slit; and a passage defined in a rear face of the fixture so that orientation of the fixture in relation to the insert is fixed.

* * * * *